US005851032A

United States Patent [19]

Green

[11] Patent Number: 5,851,032

[45] Date of Patent: Dec. 22, 1998

[54] COMPOSITE IMAGE ARRANGEMENT

[75] Inventor: Ian Macdonald Green, London, United Kingdom

[73] Assignee: Central Research Laboratories Limited, United Kingdom

[21] Appl. No.: 619,551

[22] PCT Filed: Oct. 4, 1994

[86] PCT No.: PCT/GB94/02150

§ 371 Date: Mar. 27, 1996

§ 102(e) Date: Mar. 27, 1996

[87] PCT Pub. No.: WO95/09731

PCT Pub. Date: Apr. 13, 1995

[51] Int. Cl.[6] ..... B42D 15/00

[52] U.S. Cl. ..... 283/72; 283/91

[58] Field of Search ..... 283/82, 83, 113, 283/91, 109

[56] References Cited

U.S. PATENT DOCUMENTS

| | | | |
|---|---|---|---|
| 2,952,080 | 9/1960 | E. Avakian et al. . | |
| 3,279,095 | 10/1966 | C. O. Carlson . | |
| 3,914,877 | 10/1975 | Hines . | |
| 3,969,830 | 7/1976 | Grasham . | |
| 4,033,059 | 7/1977 | Hutton et al. | 283/113 X |
| 4,200,875 | 4/1980 | Galanos | 283/113 X |
| 4,469,725 | 9/1984 | Fischer et al. | 283/113 X |
| 5,388,862 | 2/1995 | Edwards | 283/82 |
| 5,449,200 | 9/1995 | Andric et al. | 283/113 X |

FOREIGN PATENT DOCUMENTS

| | | |
|---|---|---|
| 0 260 815 | 8/1987 | European Pat. Off. . |

*Primary Examiner*—Willmon Fridie, Jr.
*Attorney, Agent, or Firm*—Evenson, McKeown, Edwards & Lenahan, P.L.L.C.

[57] ABSTRACT

This invention relates to a composite image arrangement, comprising a pattern and a further pattern, substantially parallel to the first pattern, each comprising a plurality of visually contrasting regions, the patterns being in fixed positions relative one to the other on either side of a light transmissive lamina.

13 Claims, 4 Drawing Sheets

COMPOSITE IMAGE ARRANGEMENT

This invention relates to a composite image arrangement, comprising a pattern and a further pattern, substantially parallel to the first pattern, each comprising a plurality of visually contrasting regions, the patterns being in fixed positions relative one to the other on either side of a light transmissive lamina, the visually contrasting regions of at least one pattern comprising relatively more and relatively less light transmissive regions, the patterns being aligned one to the other such that if viewed together in transmission through the said at least one pattern in a given direction relative to a normal to the plane of the patterns an image is produced which appears using normal vision to be non-random.

BRIEF DESCRIPTION OF THE INVENTION

The invention finds particular, though not exclusive, application to documents of value for the deterrence of counterfeiting. Composite image arrangements are employed in banknotes of certain currencies (for example the German Mark), but such currently used techniques still do not present a high degree of deterrence to counterfeiting because the nature of the images used enables the result of their combination to be predicted and replicated using known techniques. The image when viewed through the banknote does not change with angle of view.

An object of the present invention is to enable these disadvantages to be mitigated.

According to a first aspect of the invention a composite image arrangement as defined in the first paragraph above is characterized in that the pattern and the further pattern are such that if they are viewed in isolation using normal vision each appears substantially random.

The image may be visible only in a given range of angles relative to the normal to a pattern. The patterns may each comprise a material (such as, for example, an ink) carried on a major surface of a light transmissive lamina (such as, for example, a sheet of paper).

According to a second aspect of the invention there is provided a method of manufacturing a composite image arrangement, comprising (a) providing a pattern comprising relatively more and relatively less light transmissive regions, the pattern appearing random using normal vision, (b) providing an image pattern comprising relatively more and less light transmissive regions, the image pattern appearing non-random using normal vision, (c) combining the pattern and the image pattern using a combining function forming a further pattern comprising relatively more and less light transmissive regions, the further pattern appearing substantially random using normal vision, and (d) aligning and fixing in place the first-mentioned pattern and the further pattern to give an approximation of the image pattern when viewed together in transmission in a given direction relative to the normal to the plane of the random patterns.

The combining function may be, for example a modulo two sum, a logical operator such as "exclusive or", or a photographic process which performs a similar function.

A composite image arrangement having some similarities with the present invention is disclosed in U.S. Pat. No. 4,586,711 as part of a matching card game in which a transparent lamina with one random pattern is given to a prospective customer and a further pattern is placed on goods in a shop to encourage the prospective customer to enter the shop and match up the cards to win a prize. In this case the pattern is fairly coarse grained, precise alignment is not required, and the position of the two patterns is not fixed.

BRIEF DESCRIPTION OF THE DRAWINGS

Embodiments of the invention will now be described, by way of example only, with reference to the accompanying schematic drawings in which.

DESCRIPTION OF THE PREFERRED EMBODIMENT

Figure 5:
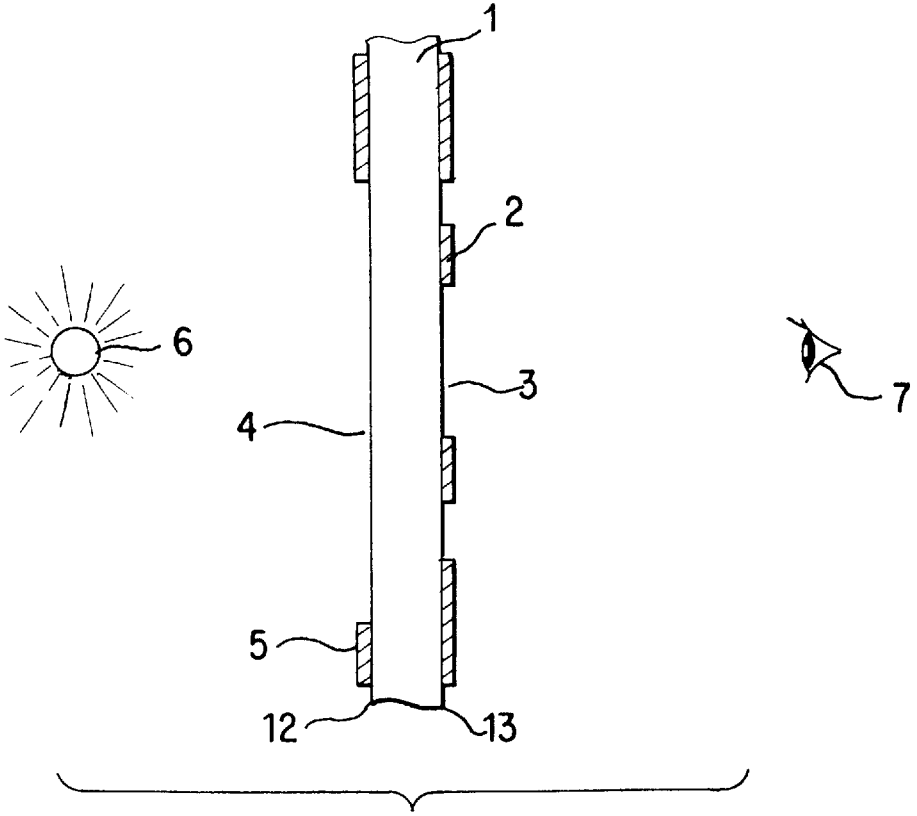
FIG. 5 shows a cross-section of a first embodiment.

In FIG. 5, a composite image arrangement has a pattern comprising visually contrasting regions having a plurality of relatively more and less light transmissive regions numbered 3 and 2 respectively, and a further pattern having visually contrasting regions comprising a plurality of relatively more and less light transmissive regions numbered 4 and 5 respectively, arranged in fixed positions on either side of a light transmissive lamina 1. The patterns both appear random when viewed in isolation using normal vision. The patterns are aligned one to the other to give a non-random image (not shown) when viewed from position 7 by light from a source 6 passing through the light transmissive lamina 1.

In the present embodiment the light transmissive lamina is constituted by a sheet of translucent paper, and the two patterns are carried on opposite major surfaces 12, 13 of the lamina and each comprise blank regions together with regions provided with ink.

Figure 2:
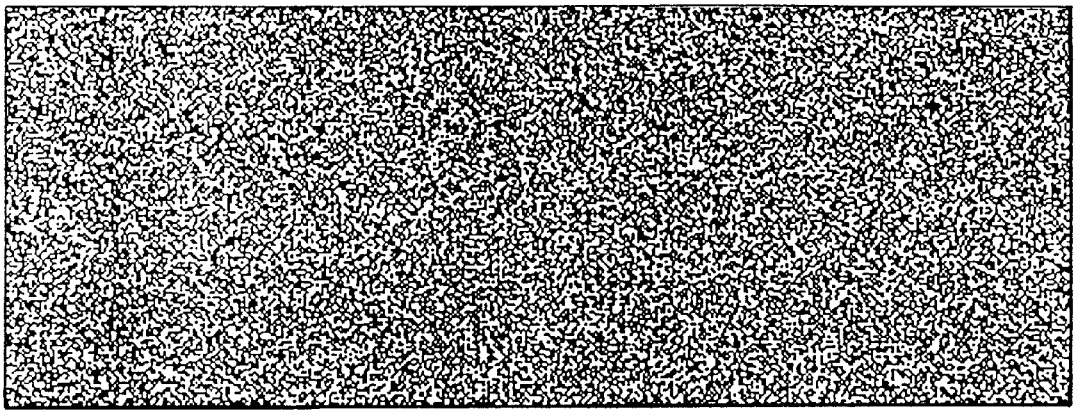
FIG. 2 shows a pattern appearing random using normal vision.
Figure 3:
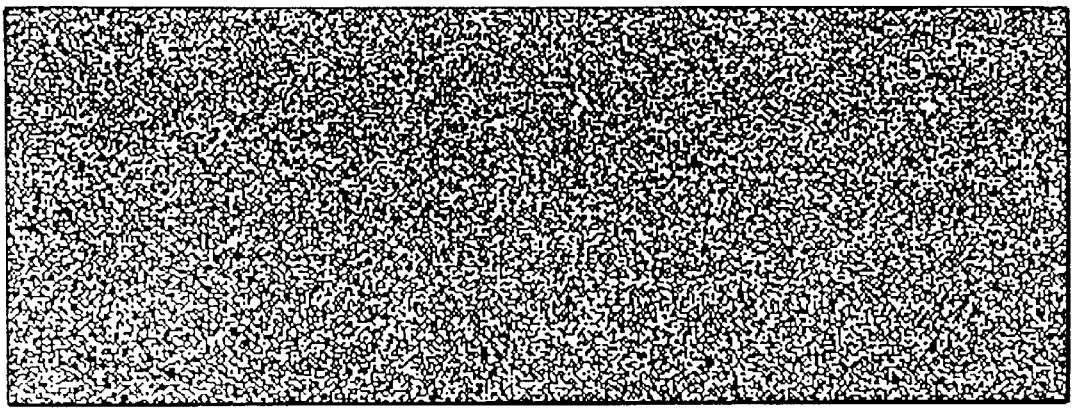
FIG. 3 shows a further pattern appearing random using normal vision.
Figure 4:
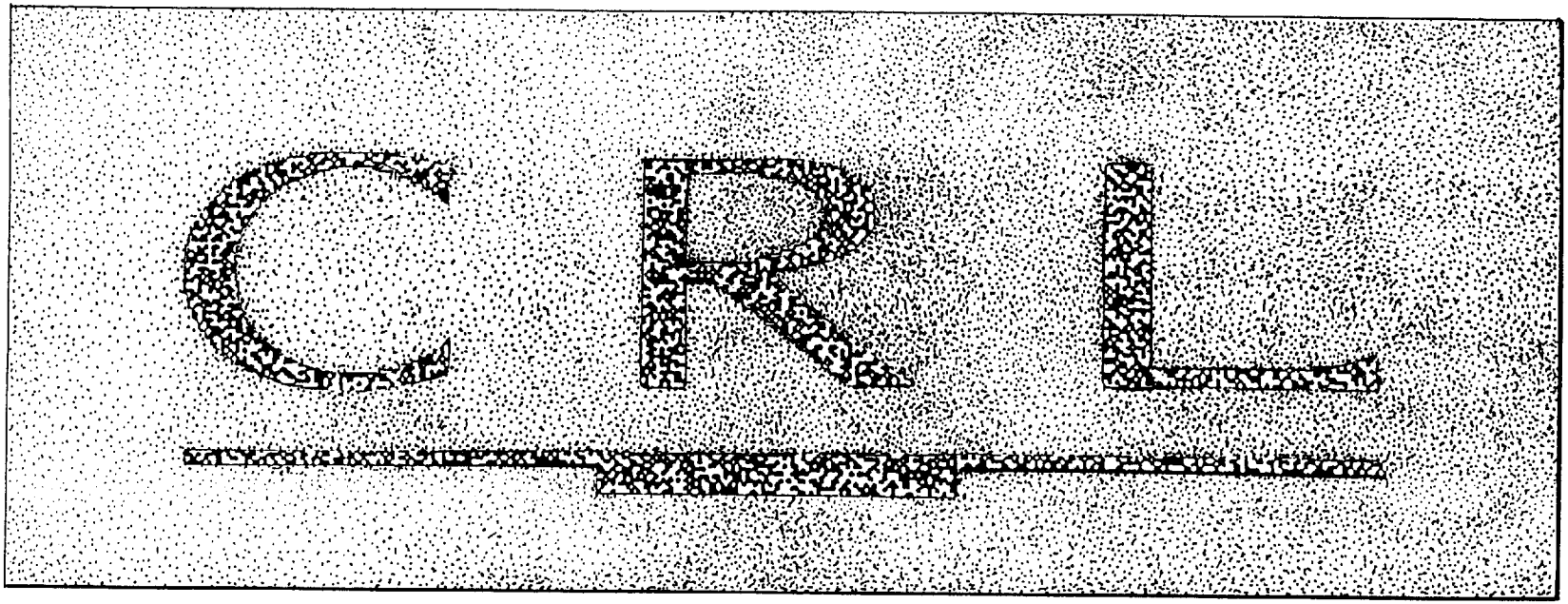
FIG. 4 shows a simulation of the image obtained by aligning FIG. 2 and FIG. 3 and viewing together in transmission.

Examples of a pattern and a corresponding further pattern are shown in FIG. 2 and FIG. 3 respectively. FIG. 2 comprises a random array of rectangular regions or pixels which have been printed onto a surface of a white paper sheet. The regions are either black or colourless depending upon whether ink has been printed in the region or not. FIG. 3 also comprises a random array of pixels of the same size (i.e. 50 per square inch) as those in FIG. 2. Although both patterns are random, information has been encoded such that when the patterns are carefully aligned and viewed in transmission, an image similar to that shown in FIG. 4 (viz. CRL) is seen. FIG. 4 is a computer simulation of the combination of the patterns in FIGS. 2 and 3 when aligned and viewed together in transmission.

Figure 6:
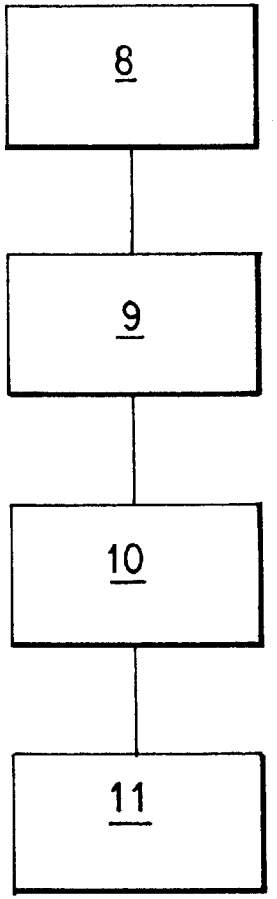
FIG. 6 shows a flow diagram of the method used to make the embodiment of FIG. 5.

The embodiment of FIG. 5 is made using the method shown in the flow diagram of FIG. 6.

The method comprises the following steps, (a) providing a pattern comprising relatively more and less light transmissive regions, the pattern appearing random using normal vision, (b) providing an image pattern comprising relatively more and less light transmissive regions, the image pattern appearing non-random using normal vision, (c) combining the pattern and the image pattern using a combining function forming a further pattern comprising relatively more and less light transmissive regions, the further pattern appearing random using normal vision, and (d) aligning the first-mentioned pattern and the further pattern to give an approximation of the image pattern when viewed together in transmission.

The first two steps (a) and (b) (labelled 8 and 9 respectively in FIG. 6) may be performed in any order, followed by the third step (c) (labelled 10 in FIG. 6) then the fourth step (d) (labelled 11 in FIG. 6).

Figure 1:
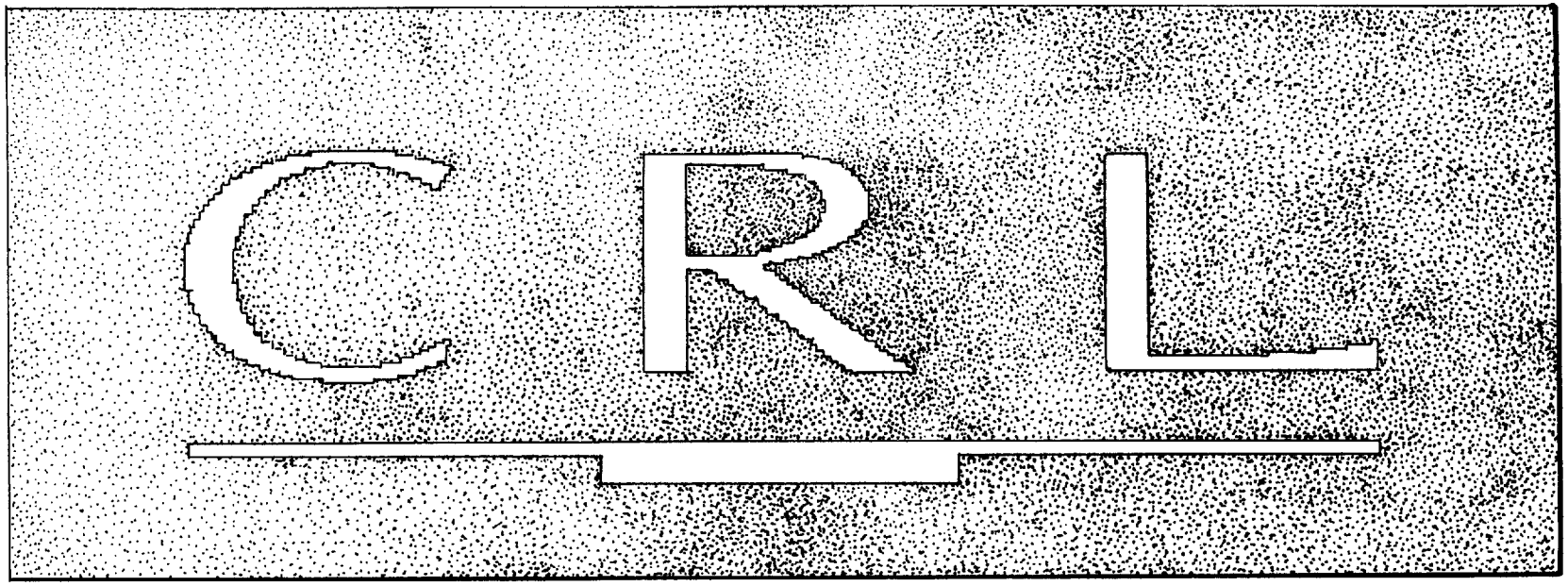
FIG. 1 shows an image pattern.

The combining function used to generate, for example, FIG. 3 from FIG. 1 and 2 is the "exclusive or" function (also known as a modulo two sum). Other more complex functions may be used but are more difficult to program on computer to generate. By combining FIG. 3 with the inverse of FIG. 2 (i.e. in which each dark pixel is changed to light transmissive and each light transmissive pixel is changed to dark) a negative image is produced in which the CRL lettering appears dark on a random grey background.

The pixel pitch of the two patterns is preferably equal, and is preferably approximately equal to the separation between the two patterns. Taking bank note paper as an example, with a thickness of 0.004", the pixels are printed 300 to the inch. When such patterns are carried on either side of the paper and aligned one to the other to within 0.001", the transmitted image is visible if viewed normal to the surface of the paper.

If however, the patterns are viewed at an angle of 30° to the normal the two patterns are apparently displaced by one pixel. If the first pattern has been appropriately chosen (for example to be random) the transmitted image will effectively disappear. To reproduce this angle dependency, the printing on opposite sides of the bank note is aligned to better than approximately 0.001". This is beyond the capability of existing photocopy technology and thus makes counterfeiting difficult.

Although in the above examples the pattern and the further pattern have approximately equal numbers of light transmissive pixels and dark pixels, arranging one image to have more dark pixels will make viewing the transmitted pattern easier from the side with the lighter pattern. This will likewise make viewing the image more difficult from the other (darker) side of the lamina.

For bank note printing, the patterns of the composite image arrangement preferably printed on either side of the sheet of paper simultaneously using equipment which has been very carefully aligned.

Although in the above examples paper has been used as the light transmissive lamina, other materials such as acetate film or other transparent or translucent materials may be used as an alternative. The patterns may be formed on separate laminae which are positioned together with at least one of the laminae being between the two patterns, or as an alternative both laminae positioned on either side of a third lamina. Such structures may be used to provide tamper-proof packaging, as once the laminae have been separated it is extremely difficult to realign them with sufficient accuracy to reform the image.

Although in the above embodiment black ink and paper without ink form the relatively more and relatively less light transmissive regions, other material such as coloured inks, or more and less exposed photographic film may be used as alternatives.

Although in the above examples the combined image can be observed using transmitted light by holding the arrangement in front of a bright light, if the light transmissive areas of the pattern closest to the observer are transparent the combined image may also be observed using light which has passed through the transparent areas and been reflected by areas of the rearmost pattern. For the arrangement to work in this case it is a requirement of the rearmost pattern simply that it contains visually contrasting regions—for example light and dark areas and/or areas having different colours, and/or reflective and non-reflective areas. It is particularly convenient for both patterns to be pixelated—i.e. made up from a plurality of small picture elements which can each have a respective tone or colour value.

Although in the above examples the pixel pitch is preferably equal for the two patterns the invention will work even when the pitches are unequal, provided corresponding parts of the two patterns appear in alignment from the position of an observer.

I claim:

1. A composite image arrangement comprising:

a light transmissive lamina;

a first pattern arranged on a first side of said lamina, said first pattern comprising a first plurality of visually contrasting regions which, viewed in isolation using normal vision, appears substantially random; and a second pattern arranged substantially parallel to the first pattern on a second side of said lamina, said second pattern being aligned in a predetermined relationship to said first pattern and held in a fixed position relative to said first pattern, and said second pattern comprising a second plurality of visually contrasting regions which viewed in isolation using normal vision, appears substantially random; wherein the visually contrasting regions of at least one pattern comprise relatively more and relatively less light transmissive regions; and arrangement of said first and second pluralities of visually contrasting regions in said first and second patterns is such that when the patterns are aligned with one another in said predetermined relationship, and are viewed together in transmission through the at least one pattern within a predetermined range of angles with respect to a predetermined direction relative to a normal to a surface of the lamina, an image is produced which appears to be non-random using normal vision.

2. A composite image arrangement according to claim 1, wherein an image which appears to be non-random is produced only when said first and second pluralities of visually contrasting regions are aligned in said predetermined relationship.

3. A composite image arrangement as claimed in claim 1 in which the patterns each comprise relatively more and relatively less light transmissive regions.

4. A composite image arrangement as claimed in claim 1 in which the patterns each comprise material carried on a major surface of a light transmissive lamina.

5. A composite image arrangement as claimed in claim 1 in which the patterns each comprise material carried on opposite major surfaces of a light transmissive lamina.

6. A composite image arrangement as claimed in claim 1 in which the image is visible only within said range of angles to a given direction relative to the normal to the surface of the lamina.

7. A composite image arrangement as claimed in claim 1 in which the relatively more and less light transmissive regions in the pattern have a characteristic minimum dimension in the plane of the pattern which is approximately equal to or less than a distance between the patterns defined by a thickness of the lamina.

8. A method of manufacturing a composite image arrangement, comprising:

providing a first pattern comprising a first plurality of relatively more and relatively less light transmissive regions which appear random using normal vision;

providing an image pattern comprising relatively more and less light transmissive regions which appear non-random using normal vision;

combining the first pattern and the image pattern using a combining function to form a second pattern comprising a second plurality of relatively more and less light transmissive regions which appear random using normal vision, arrangement of said first and second pluralities of relatively more and less light transmissive regions in said first and second patterns being such that when the patterns are aligned with one another in a predetermined relationship, and are viewed together in transmission within a predetermined range of angles with respect to a given direction relative to a normal to a contour of the patterns, an approximation of the image pattern is produced; and aligning and fixing in place the first and second patterns in said predetermined relationship.

9. A method as claimed in claim 8 in which the combining function is the logical operator "exclusive or".

10. A method as claimed in claim 8, in which the first pattern and the further pattern are arranged on either side of a light transmissive lamina.

11. A method as claimed in claim 10, in which the first pattern and the second pattern are carried on opposite major surfaces of a light transmissive lamina.

12. A method as claimed in claim 11 in which the light transmissive lamina comprises a sheet of paper.

13. A method as claimed in claim 8 in which the approximation of the given pattern is an approximation of the negative of the given pattern.

* * * * *